United States Patent [19]

Douty et al.

[11] 4,108,527

[45] Aug. 22, 1978

[54] STRAIN RELIEF ASSEMBLY

[75] Inventors: George Harold Douty, Mifflintown; John Edward Lucius, Harrisburg; Larry Leon Leitzel, Klingerstown, all of Pa.

[73] Assignee: AMP Incorporated, Harrisburg, Pa.

[21] Appl. No.: 809,507

[22] Filed: Jun. 23, 1977

[51] Int. Cl.[2] ..... H01R 13/58

[52] U.S. Cl. ..... 339/107; 339/59 M; 339/206 P

[58] Field of Search ..... 339/107, 103 C, 103 R, 339/103 M, 206 P, 207 R, 207 S, 208, 209, 59 M

[56] References Cited

U.S. PATENT DOCUMENTS

| | | | |
|---|---|---|---|
| 3,056,942 | 10/1962 | Carbaugh et al. | 339/103 M X |
| 3,671,921 | 6/1972 | Baker et al. | 339/59 M |
| 3,854,787 | 12/1974 | Snyder, Jr. | 339/103 R |
| 3,856,376 | 12/1974 | Poliak et al. | 339/107 |
| 3,904,265 | 9/1975 | Hollyday et al. | 339/103 M |
| 4,029,896 | 6/1977 | Skinner | 339/208 X |

*Primary Examiner*—Roy Lake
*Assistant Examiner*—DeWalden W. Jones
*Attorney, Agent, or Firm*—Russell J. Egan

[57] ABSTRACT

An improved strain relief assembly is disclosed for use with cables of a wide variety of cross-sectional areas. The assembly includes a pair of hermaphroditic housing members each of which receives therein one of a plurality of cable engaging members having a profiled cable engaging face and being of such dimension as to provide, in combination with another member, a wide variety of cable receiving openings. In an alternate embodiment, the cable engaging members include a resilient portion whereby the members are self biasing. The housing members have intermating latching members to secure them together in an assembled condition. The housing members also include a profiled forward end having connector housing engaging means whereby the strain relief assembly may be secured to a known connector.

8 Claims, 5 Drawing Figures

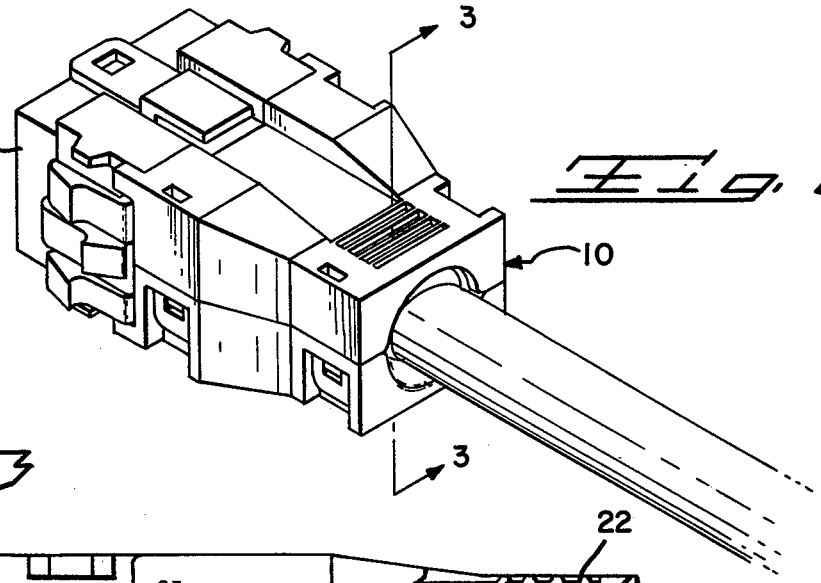
Fig. 2
Fig. 3
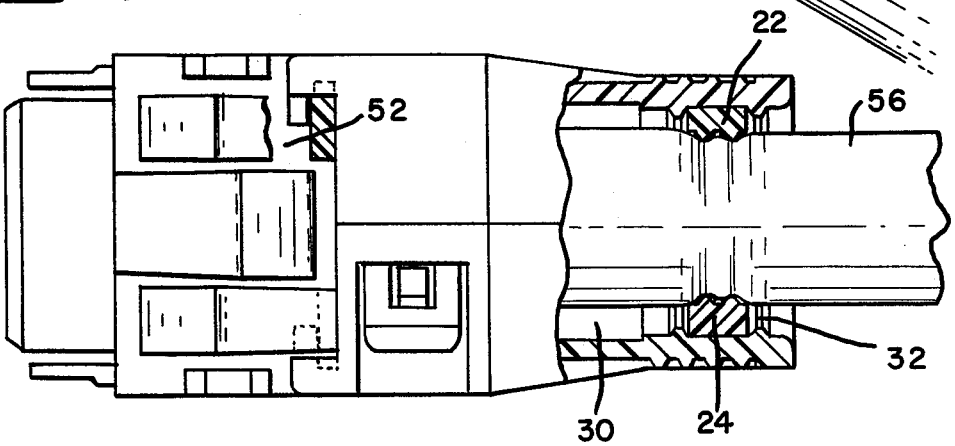
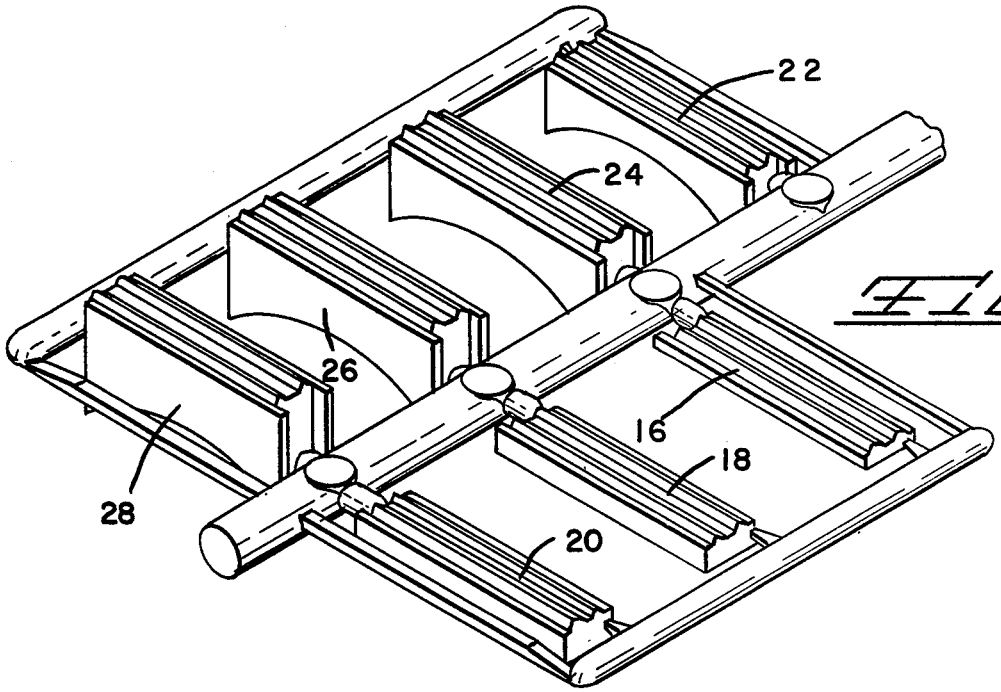
Fig. 4

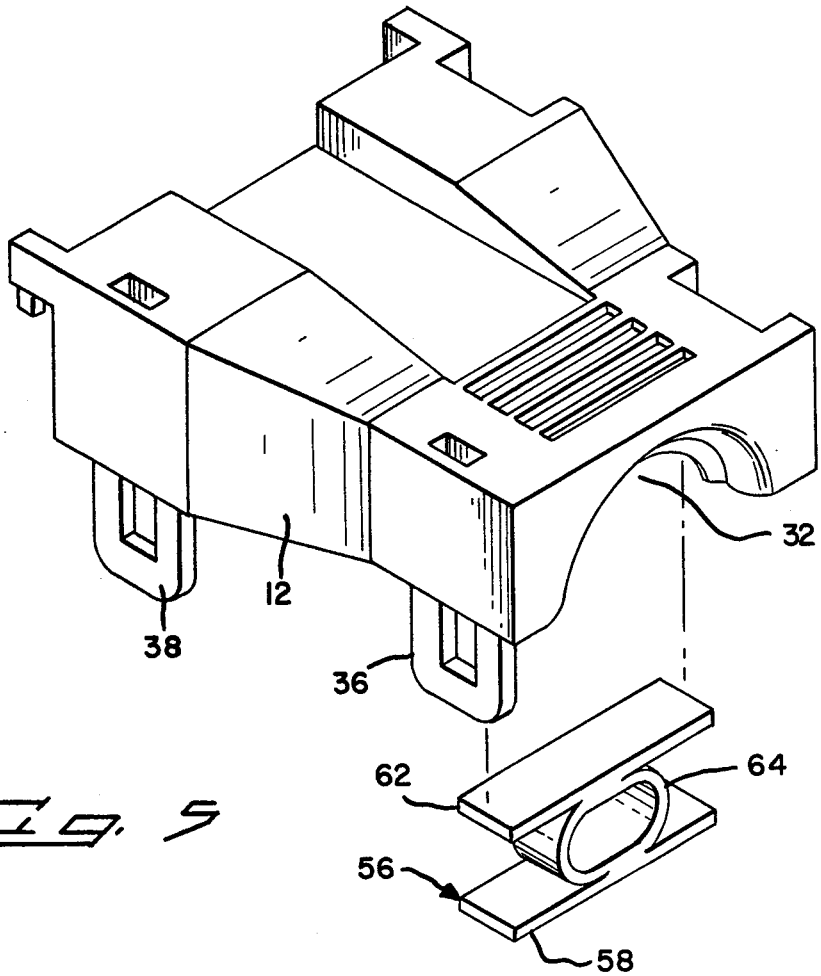
Fig. 5
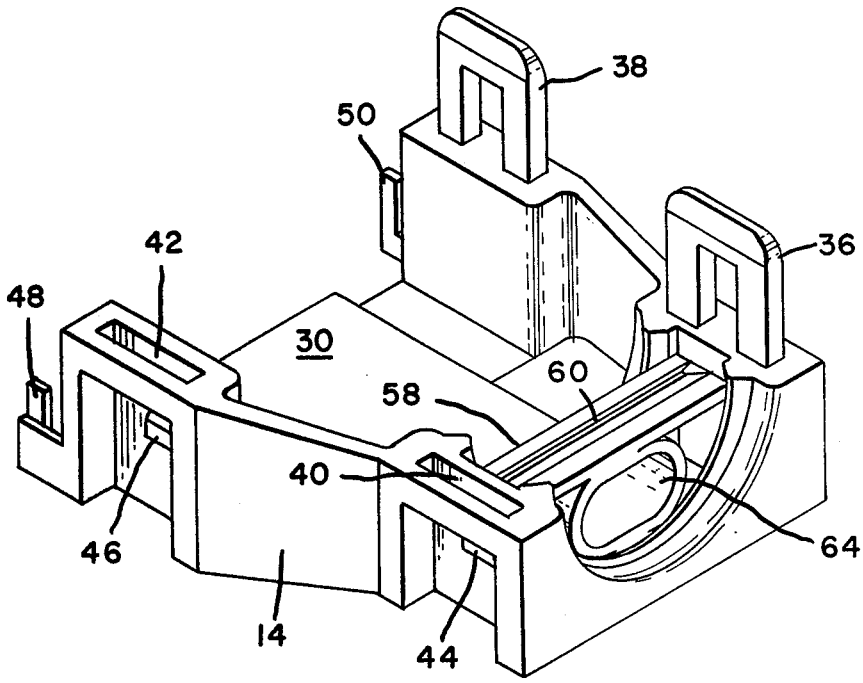

STRAIN RELIEF ASSEMBLY

BACKGROUND OF THE INVENTION

1. The Field Of The Invention

The present invention relates to a cable strain relief assembly for electrical connectors and in particular to a cable strain relief assembly which is able to accommodate a wide range of cable dimensions.

2. The Prior Art

There are a wide variety of known strain relief devices for electrical cables. However, most of these devices have some peculiar drawback, such as the inability to hold the cable in a straight line coming out of the connector. An example of this type strain relief device can be seen in U.S. Pat. No. 3,671,921.

Also representative of the prior art of cable strain relief devices are the following U.S. Pat. Nos.: 3,056,942; 3,854,787; and 3,904,265. The primary difficulty with most of these known strain relief devices is the limited range of cable sizes which they can handle.

SUMMARY OF THE INVENTION

The present invention constitutes a strain relief assembly for use with known electrical connectors. The subject assembly includes a pair of hermaphroditic housing members which together define a cable passage. Each housing member has a recess extending transverse to the passage and adapted to receive therein one of a plurality of cable engaging members, each having at least one profiled cable engaging surface. The plurality of cable engaging members together form a step-wise progression of increasingly larger dimensions whereby insertion of selected cable engaging members into the transverse recesses defines a specifically sized aperture for receiving an appropriate cable.

It is therefore an object of the present invention to produce an improved strain relief assembly which can be readily adopted to accommodate cables having a wide range of cross-sectional dimensions.

It is a further object of the present invention to produce a cable strain relief assembly which can be readily mounted on a known electrical connector to provide strain relief for the conductors leading thereto, regardless of the number and thickness of the conductors.

It is a further object of the present invention to produce a strain relief assembly which can be readily and economically manufactured.

The means for accomplishing the foregoing objects and other advantages of the present invention will become apparent to those skilled in the art from the following detailed description taken with reference to the accompanying drawings.

BRIEF DESCRIPTION OF THE DRAWINGS

FIG. 2 is a perspective view of the subject assembly in a closed condition engaging both an associated connector and a cable;

FIG. 3 is a side elevation of the subject invention with a partial section taken along line 3—3 of FIG. 2;

FIG. 4 is a perspective view of a ladder of cable engaging members; and

FIG. 5 is an exploded perspective view, similar to FIG. 1, showing an alternate embodiment of the cable engaging member.

DETAILED DESCRIPTION OF THE PREFERRED EMBODIMENT

Figure 1:
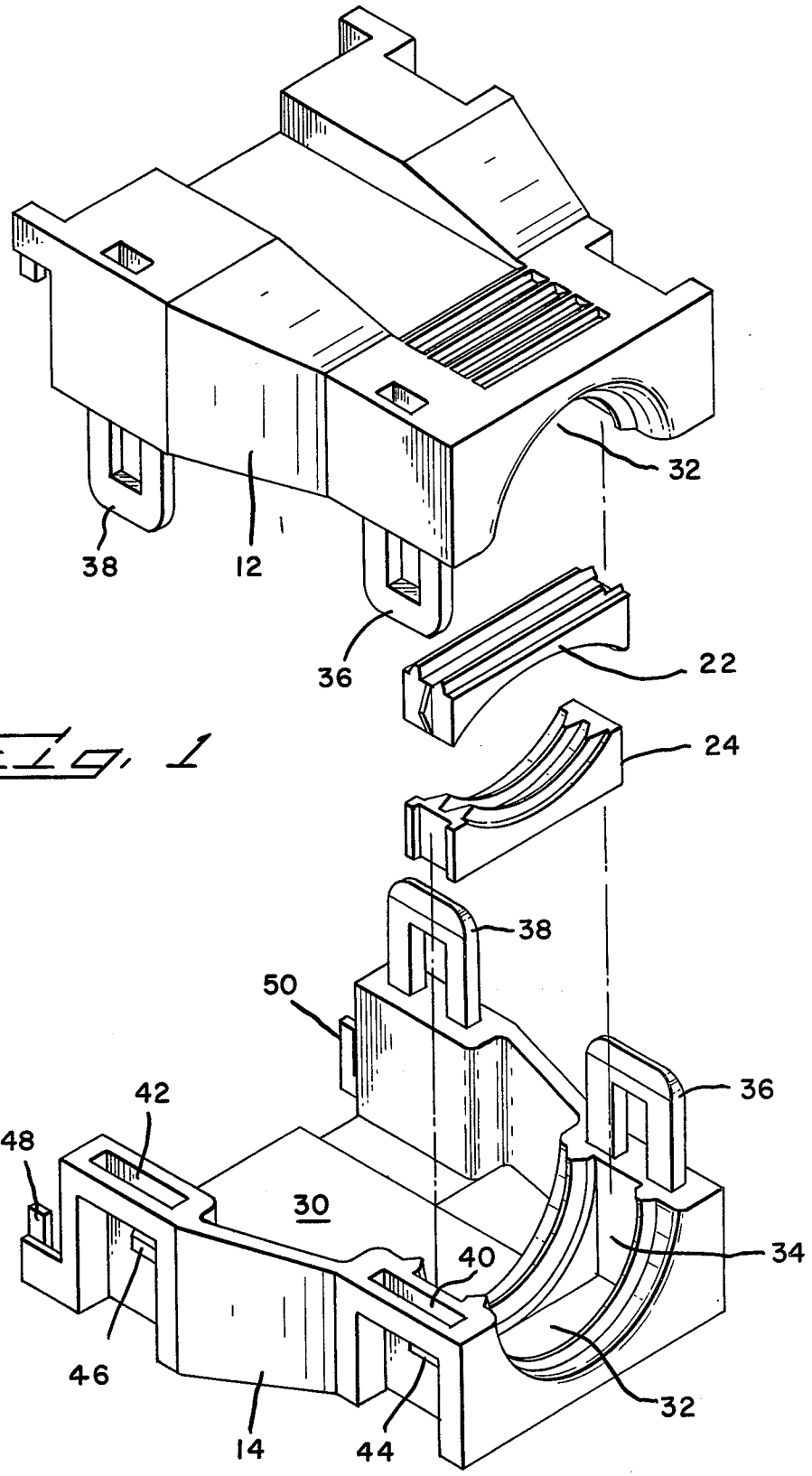
FIG. 1 is an exploded perspective view of the subject strain relief assembly.

The subject cable strain relief assembly 10 includes a pair of hermaphroditic housing members 12, 14 and a plurality of cable engaging members 16, 18, 20, 22, 24, 26, and 28. Housing members 12, 14 together define therebetween a first cable chamber 30 and a cable passage 32 which has a recess 34 extending transversely thereacross. Each of the recesses 34 receives therein one of the cable engaging members 16, 18, 20, 22, 24, and 26. The hermaphroditic housing members 12, 14 also include intermating latching means including the latching ears 36, 38 and slots 40, 42 with respective detents 44, 46. The housing members further include rigid tines 48, 50 for engaging in respective slots or apertures 52 of a connector housing member 54 to secure the strain relief on the connector member. It should be noted here that the connector member 54 shown is similar to the connectors shown and described in U.S. Pat. Nos. 3,569,909 and 3,989,343, although other known connectors could be used.

The cable engaging members 16, 18, 20, 22, 24, 26, 28 can be produced in a wide variety of shapes and sizes. The representative embodiment in FIG. 4 shows a stepped progression of seven members which are profiled to have eleven cable engaging faces. Each cable engaging face includes a pair of parallel extending spaced ridges. The members 16, 18 and 20 are planar and have ridges only on a single surface. They are also of different thicknesses. The members 22, 24, 26, 28, also are progressively thicker and each has a first planar surface, with a pair of parallel ridges, and a second arcuate surface, likewise having a pair of arcuate ridges. The difference in configuration between the sides of the members 22, 24, 26 and 28 can perhaps best be seen in FIG. 1.

The subject strain relief assembly is utilized by first selecting the proper size and shape cable engaging members from the ladder configuration shown in FIG. 4. These members are readily snapped from the ladder and inserted into the respective recesses 34. The housing members 12, 14 are then clamped together on the connector housing 54 while simultaneously engaging the cable 56 with the cable engaging members.

An alternate embodiment of the subject cable engaging members 56 is shown in FIG. 5. These members have a cable engaging portion 58 with at least one transverse rib 60 on the face thereof. A base portion 62 is integrally connected to the cable engaging portion 58 by a resilient portion 64, here shown as an arcuate pair of arms. The cable engaging members 56 are inserted into the housing members 12, 14 in the same manner as the cable engaging members 16, 18, 20, 22, 24, 26, 28. However, since members 56 include a resilient portion they are self biasing and can accommodate a fairly wide range of cable dimensions.

The present invention may be subject to many modifications and changes without departing from the spirit or essential characteristics thereof. The present invention is therefore to be considered in all respects as illustrative and not restrictive of the scope of the invention.

What is claimed is:

1. An improved strain relief assembly comprising:

a pair of hermaphroditic housing members having means to latchingly secure said housing members together, said housing members together defining a cable passage therebetween, at least one recess in each said housing member aligned with a like recess in the other housing member and extending transversely of said passage, and means to engage an associated electrical connector housing; and at least two cable engaging members each having at least one profiled cable engaging face with at least one ridge extending longitudinally thereacross, said cable engaging members being profiled to be received in said recesses of said housing members;

whereby insertion of a selected pair of cable engaging members into said recesses defines a cable opening of desired size and configuration to clampingly engage an associated cable received therein.

2. The strain relief assembly according to claim 1 wherein each said cable engaging member includes at least one planar face having a pair of ridges extending thereacross.

3. A strain relief assembly according to claim 1 wherein at least some of said cable engaging members have an arcuate cable engaging face with at least one ridge extending along the major axis of said face.

4. A strain relief assembly according to claim 1 wherein at least some of said cable engaging members have a first cable engaging face with at least one ridge extending along the major axis thereof and a second arcuate cable engaging face having at least one second ridge extending along the major axis thereof.

5. A strain relief assembly according to claim 1 wherein said cable engaging members together have a stepwise progression of thicknesses.

6. A strain relief assembly according to claim 1 wherein said cable engaging members have a resilient portion whereby said face is biased against a cable.

7. A strain relief assembly according to claim 1 wherein said cable engaging members have a base portion attached to said cable engaging face by resilient means whereby said face is biased against a cable.

8. An improved strain relief assembly comprising:

a pair of hermaphroditic housing members having means to latchingly secure said housing members together, said housing members together defining a cable passage therebetween, a recess in each said housing member aligned with a like recess in the opposite housing member and extending transversely of said passage, and means to latchingly engage an associated electrical connector housing; and a pair of cable engaging members each having one profiled cable engaging portion with a pair of parallel spaced ridges extending longitudinally across the face thereof, a base portion, and resilient means securing said portions together, said cable engaging members being profiled to be received in said recesses of said housing members;

whereby said pair of cable engaging members in said recesses defined a cable opening and the faces thereof are biased against an associated cable received therein.

* * * * *